US010010165B1

(12) United States Patent
LaFortune et al.

(10) Patent No.: US 10,010,165 B1
(45) Date of Patent: Jul. 3, 2018

(54) TOOTHPASTE EXTRUDING TOOTHBRUSH

(71) Applicants: Ricardo LaFortune, Somerset, NJ (US); Kenneth R. Jones, Wayne, NJ (US)

(72) Inventors: Ricardo LaFortune, Somerset, NJ (US); Kenneth R. Jones, Wayne, NJ (US)

( * ) Notice: Subject to any disclaimer, the term of this patent is extended or adjusted under 35 U.S.C. 154(b) by 61 days.

(21) Appl. No.: 15/212,269

(22) Filed: Jul. 17, 2016

Related U.S. Application Data

(60) Provisional application No. 62/199,212, filed on Jul. 30, 2015.

(51) Int. Cl.
*A46B 11/00* (2006.01)

(52) U.S. Cl.
CPC ..... *A46B 11/0006* (2013.01); *A46B 11/00* (2013.01)

(58) Field of Classification Search
CPC combination set(s) only.
See application file for complete search history.

(56) References Cited

U.S. PATENT DOCUMENTS 1,521,783 A * 1/1925 Mendoza ..... A46B 11/0041 401/269
1,677,194 A * 7/1928 Mendoza ..... A46B 11/0079 401/281
1,959,126 A * 5/1934 De Luca ..... A46B 11/0024 401/155
2,779,505 A * 1/1957 Sipmann ..... B65D 35/34 222/100
5,382,106 A * 1/1995 Voigt ..... A46B 11/0017 222/100
8,851,782 B2 * 10/2014 Pei ..... A46B 11/0037 401/152

* cited by examiner

*Primary Examiner* — David Walczak
(74) *Attorney, Agent, or Firm* — RG Patent Consulting, LLC; Rachel Gilboy

(57) ABSTRACT

The toothpaste extruding toothbrush is a toothbrush assembly having a slotted, hollow, inner volume within the handle covered by a diaphragm which is held in place by a snap on top having a slotted lengthwise opening centered on top that a thumb roller partially extends through which is operated by the thumb of a user to deform the diaphragm to force toothpaste from the inner volume into the extrusion passage and into the bristles.

1 Claim, 4 Drawing Sheets

TOOTHPASTE EXTRUDING TOOTHBRUSH

CROSS-REFERENCE TO RELATED APPLICATION

The present application is related to and claims priority from prior provisional application Ser. No. 62/199,212, filed Jul. 30, 2015 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of tooth brushes and more specifically relates to a toothpaste extruding toothbrush.

2. Description of the Related Art

Brushing one's teeth is one of the most important parts of healthy hygiene. In addition to freshening the breath and strengthening the teeth, proper brushing also kills the germs and bacteria that can grow inside the mouth. Recently, the Office of the Surgeon General released its first ever report on the oral health of America and the results were surprising. According to the report, the most common chronic childhood disease by far in this country is tooth decay. In fact, American children lose a staggering 512 million school hours a year due to dental related illness.

Adults also suffer from various forms of dental disease and these complications can lead to painful oral surgeries and costly trips to the dentist. A booming industry, the national health expenditures for dental services exceeded sixty billion dollars in 2013. While the Office of the Surgeon General reports that there have been vast improvements in the past fifty years regarding oral health issues, much can still be done in this area. Health professionals maintain that through education and a concerted effort, the number of adults and children suffering from dental disease can be significantly reduced.

To have a healthy smile, the American Dental Association recommends that teeth should be brushed at least twice daily, preferably after meals. However, this recommendation can often prove to be easier said than done. With the hustle and bustle of busy work and school days, it is simply not practical to cart around a toothbrush and a bulky, messy tube of toothpaste. As a result, consumers are unable to brush their teeth after a lunch meeting or immediately following an afternoon snack. The longer food particles remain in the mouth, the teeth can become susceptible to the formation of cavities and decay. Those who are enjoying a leisurely, though busy day of shopping or travel face this dilemma as well. Taking in sights or juggling shopping bags, there is no expedient way to properly care for oral health after every quick bite.

Various attempts have been made to solve problems found in disposable toothbrush devices comprising toothpaste art. Among these are found in: U.S. Pub. No. 2013/0266361 to Jeffrey A. Gilbert; U.S. Pat. No. 4,265,560 to Joseph P. Spica; U.S. Pat. No. 5,908,257 to Todd A. Martin; and U.S. Pat. No. 5,599,126 to Cheryl Hough. This prior art is representative of tooth brushes. None of the above inventions and patents, taken either singly or in combination, is seen to describe the invention as claimed.

Ideally, a tooth brushes should provide convenience when away from home, and yet, would operate reliably and be manufactured at a modest expense. Thus, a need exists for a reliable, toothbrush device that can extrude toothpaste into the bristles to avoid the above-mentioned problems.

BRIEF SUMMARY OF THE INVENTION

In view of the foregoing disadvantages inherent in the known tooth brush art, the present invention provides a novel toothpaste extruding toothbrush. The general purpose of the present invention, which will be described subsequently in greater detail, is to provide a toothbrush device that can extrude toothpaste into the bristles.

The toothpaste extruding toothbrush preferably comprises a toothbrush assembly having a head portion including a bristle surface and a bottom section. The bristle surface and the bottom section are integrally formed with each other. A bristle set is located on the bristle surface of the head portion and is adapted to include a plurality of bristles. The handle portion is adapted to include a bottom portion and a top portion. The bottom portion and the top portion are snapped together to form an inner volume and an outer gripping portion with the bottom portion integrally formed with the head portion. The toothbrush assembly further has an extruder that is located within the inner volume and is adapted to adjust the inner volume capacity. Included with the extruder is a diaphragm and a roller.

The diaphragm is a flexible membrane that is deformable. The inner volume is adapted to have an edge recess that the edges of the diaphragm are nestably seated within. The top portion of the handle portion is adapted to be a retainer to secure the diaphragm and the roller in place within the inner volume. The wheel of the extruder is a thumb roller and the top portion of the handle portion further is adapted to include a lengthwise slotted opening for the thumb roller to extend partially therethrough such that the thumb roller is operable via the thumb of a user. The slotted opening further has a proximal end and a distal end. The thumb roller is adapted to traverse the slotted opening from the proximal end to the distal end via a thumb to extrude the toothpaste composition. The thumb roller directly contacts the diaphragm and a portion of the thumb roller extends downward into the elongated slot deforming the diaphragm while being operated.

The extrusion passage has a first end and a second end and the first end of the extrusion passage is connected to the inner volume of the handle portion and the second end of the extrusion passage is located on the bristle surface such that an exterior orifice is formed. The exterior orifice of the extrusion passage is located among the bristles of the bristle set. The inner volume of the handle portion is adapted to be an elongated slot having a first end and a second end, the second end being connected with the extrusion passage, the thumb wheel progresses from the proximal end of the elongated slot toward the distal end of the elongated slot when in use and the inner volume is reduced causing an extrusion of the toothpaste composition from the inner volume through the extrusion passage and through the orifice.

The thumb wheel further is adapted to have a center axle extending outwardly from the center of the wheel that is designed to travel within a track to prevent the thumb wheel from binding angularly. The toothpaste composition contained within the inner volume is able to be extruded therefrom through the extrusion passage and through the exterior orifice into the bristle set via the extruder.

The toothbrush assembly further comprises a snap on cover which conceals the bristle set and the top portion. The inner volume of the handle portion is able to be refilled with a toothpaste composition for more than one use. The toothpaste extruding toothbrush is a convenient and easy to use carry combination for oral hygiene when away from a home or to carry for ready convenience and may be manufactured as a disposable travel device or may be manufactured as a re-useable device.

The present invention holds significant improvements and serves as a toothpaste extruding toothbrush. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, toothpaste extruding toothbrush, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a tooth brush and more particularly to a disposable toothpaste extruding toothbrush as used to improve the convenience of oral hygiene through a disposable, toothbrush device that can extrude toothpaste into the bristles.

Generally speaking, the toothpaste extruding toothbrush is a toothbrush assembly having a slotted, hollow, inner volume within the handle covered by a diaphragm which is held in place by a snap on top having a slotted lengthwise opening centered on top that a thumb roller partially extends through which is operated by the thumb of a user to deform the diaphragm to force toothpaste from the inner volume into the extrusion passage and into the bristles.

Figure 1:
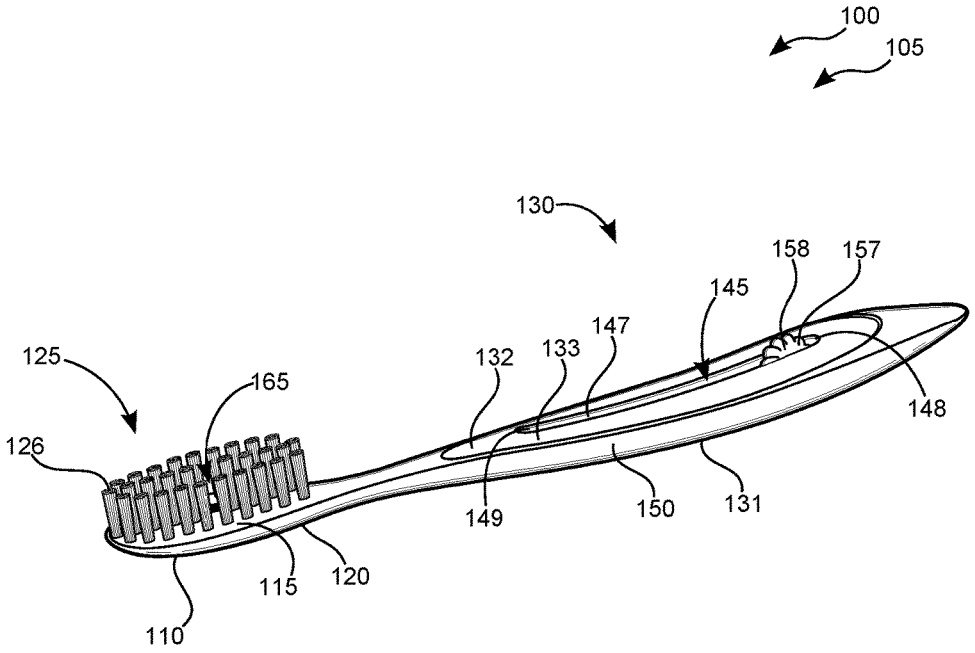
FIG. 1 shows a perspective view illustrating a toothpaste extruding toothbrush according to an embodiment of the present invention.

Referring to the drawings by numerals of reference there is shown in FIG. 1, shows a perspective view illustrating toothpaste extruding toothbrush 100 according to an embodiment of the present invention.

Toothpaste extruding toothbrush 100 preferably comprises toothbrush assembly 105 having head portion 110 including bristle surface 115 and bottom section 120. Bristle surface 115 and bottom section 120 are integrally formed with each other. Bristle set 125 is located on bristle surface 115 of head portion 110 and is adapted to include a plurality of bristles 126. Handle portion 130 is adapted to include bottom portion 131 and top portion 132. Bottom portion 131 and top portion 132 are snapped together to form inner volume 145 and outer gripping portion 150 with bottom portion 131 integrally formed with head portion 110. Toothbrush assembly 105 further has extruder 155 that is located within inner volume 145 and is adapted to adjust inner volume 145 capacity. Included with extruder 155 is diaphragm 156 and roller 157.

Figure 2:
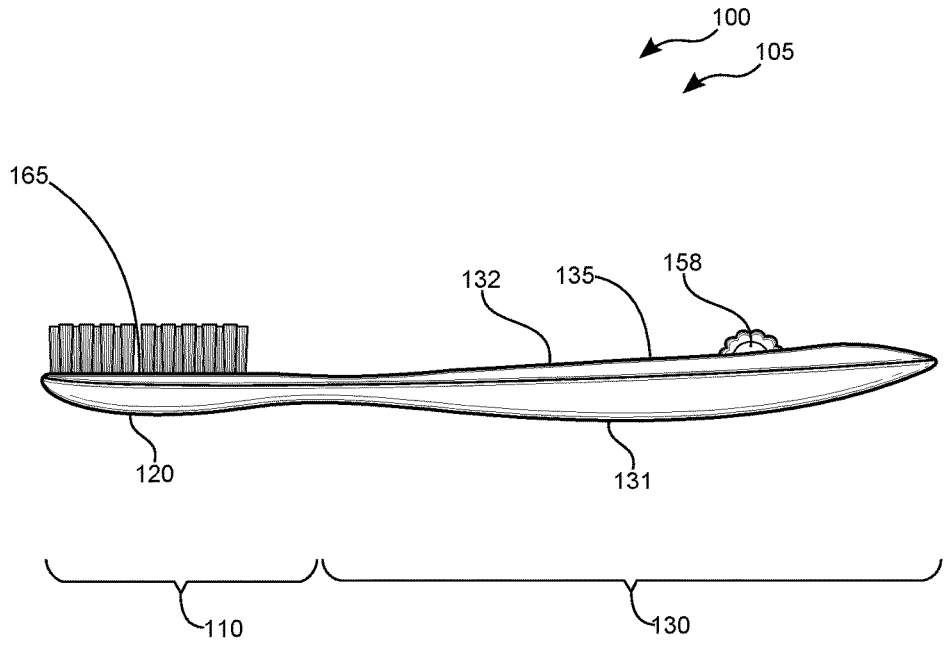
FIG. 2 is a side view illustrating a toothpaste extruding toothbrush according to an embodiment of the present invention of FIG. 1.

Referring now to FIG. 2, is a side view illustrating toothpaste extruding toothbrush 100 according to an embodiment of the present invention of FIG. 1.

FIG. 2 is showing a different view that depicts the proportions of an embodiment of toothbrush assembly 105 showing head portion 110 including bristle surface 115 and bottom section 120 as well as handle portion 130. Separate bristles 126 make up bristle set 125 and may be soft, medium, or hard bristles for the preference of the user. Handle portion 130 is adapted to include bottom portion 131 and top portion 132. Bottom portion 131 and top portion 132 are snapped together to form inner volume 145 and an outer gripping portion 150 with bottom portion 131 integrally formed with head portion 110. Snap on cover 175 protects bristles 126 and extruder 155 area from contamination or unintentionally getting water or toothpaste composition 195 on unintended surfaces.

Figure 3:
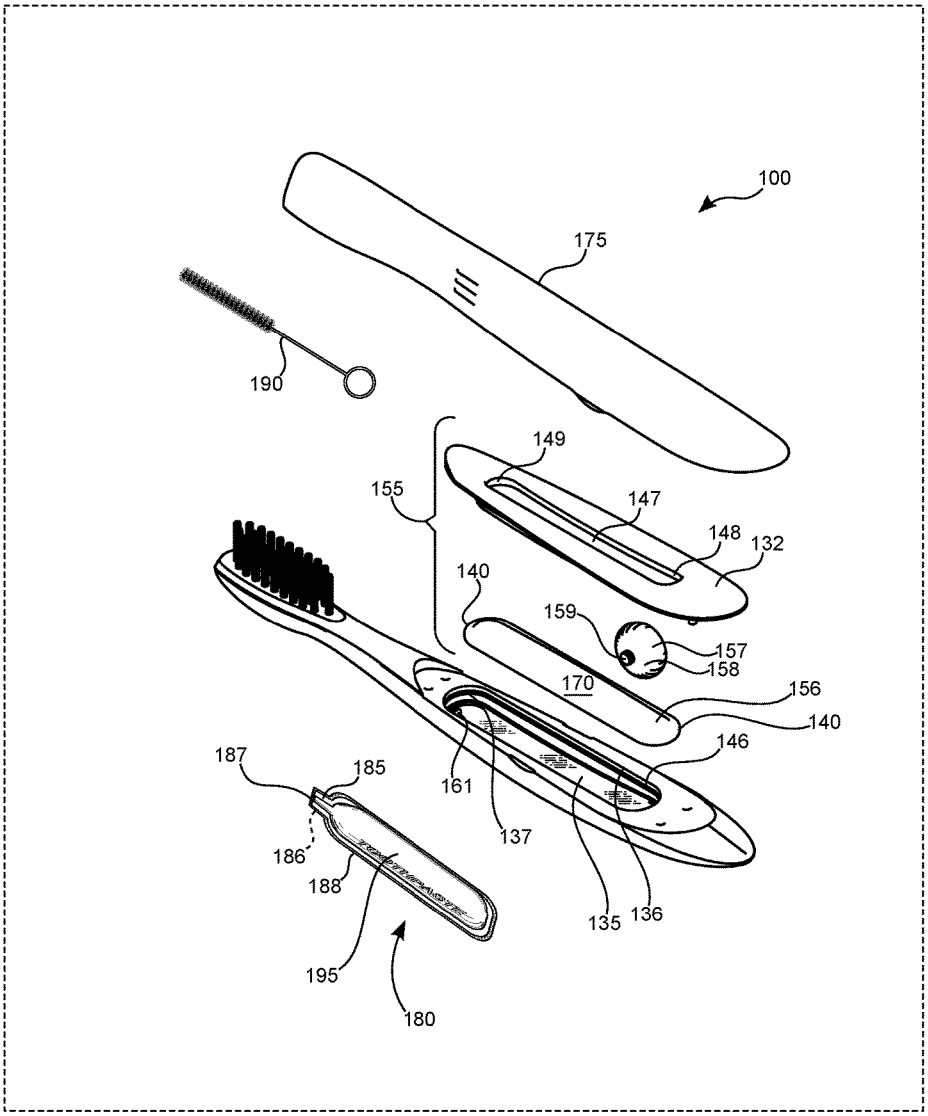
FIG. 3 is an exploded view illustrating toothpaste extruding toothbrush according to an embodiment of the present invention of FIG. 1.

Referring now to FIG. 3, is an exploded view illustrating toothpaste extruding toothbrush 100 according to an embodiment of the present invention of FIG. 1.

Bristle surface 115 and bottom section 120 are of one piece construction with each other, but may be two piece construction before being fused together for facilitating the manufacturing of extrusion passage 160 running centrally through head portion 110 from inner volume 145. Second end 162 of extrusion passage 160 may be formed at a 90 degree upward angle to the main portion of extrusion passage 160 having exterior orifice 165 located among bristles 126. Bristle set 125 is located on bristle surface 115 of head portion 110 and is adapted to include a plurality of bristles 126 that may be counter sunk into the surface of bristle surface 115 during a hot process while forming. Handle portion 130 is adapted to include bottom portion 131 and top portion 132. Bottom portion 131 and top portion 132 are snapped together to form inner volume 145 and outer gripping portion 150 with bottom portion 131 integrally formed with head portion 110. Toothbrush assembly 105 further has extruder 155 that is located within inner volume 145 and is adapted to adjust inner volume 145 capacity. Included with extruder 155 is diaphragm 156 and roller 157.

Diaphragm 156 is a flexible membrane that is deformable. Inner volume 145 is adapted to have edge recess 146 that edges 140 of diaphragm 156 are nestably seated within. Top portion 132 of handle portion 130 is adapted to be a retainer to secure diaphragm 156 and roller 157 in place within inner volume 145. Roller 157 of extruder 155 is thumb roller 158 and top portion 132 of handle portion 130 further is adapted to include a lengthwise slotted opening 147 for thumb roller 158 to extend partially therethrough such that thumb roller 158 is operable via the thumb of a user. Slotted opening 147 further has proximal end 148 and distal end 149. Thumb roller 158 is adapted to traverse slotted opening 147 from proximal end 148 to distal end 149 via a thumb to extrude toothpaste composition 195. Thumb roller 158 further is adapted to have center axle 159 extending outwardly from the center of roller 157 that is designed to travel within a track to prevent thumb roller 158 from binding angularly.

Toothbrush assembly 105 further comprises snap on cover 175 which conceals bristle set 125 and top portion 132. Inner volume 145 of handle portion 130 is able to be refilled with toothpaste composition 195 for more than one use. Toothpaste extruding toothbrush 100 is a convenient and easy to use carry combination for oral hygiene when away from a home or to carry for ready convenience after meals and may be manufactured as a disposable travel device or may be manufactured as a re-useable device. In embodiments that are re-useable, toothpaste composition 195 may be placed directly in inner volume 145 or may be placed in inner volume using disposable refill packets 180 having nozzle first portion 185 and nozzle second portion 186 with the end of nozzle 187 much easier to rupture than perimeter edge 188 when exerting pressure from thumb roller 158.

Figure 4:
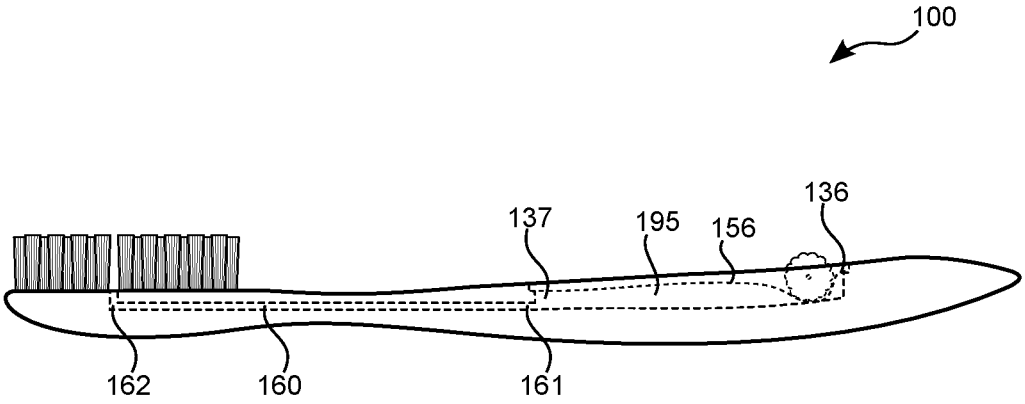
FIG. 4 is a cutaway view illustrating toothpaste extruding toothbrush according to an embodiment of the present invention of FIG. 1.

Referring now to FIG. 4, is a cutaway view illustrating extrusion passage 160 of toothpaste extruding toothbrush 100 according to an embodiment of the present invention of FIG. 1.

Inner volume 145 of handle portion 130 is adapted to be elongated slot 135 having first end 136 and second end 137, second end 137 being connected with extrusion passage 160. Thumb roller 158 progresses from first end 136 of elongated slot 135 toward second end 137 of elongated slot 135 when in use and inner volume 145 is reduced causing an extrusion of toothpaste composition 195 from inner volume 145 through extrusion passage 160 and through exterior orifice 165. Thumb roller 158 directly contacts diaphragm 156 and a portion of thumb roller 158 extends downward into elongated slot 135 deforming diaphragm 156 while being operated via thumb roller 158. Extrusion passage 160 has first end 161 and second end 162 and first end 161 of extrusion passage 160 is connected to inner volume 145 of handle portion 130 and second end 162 of extrusion passage 160 is located on bristle surface 115 such that an exterior orifice 165 is formed. Exterior orifice 165 of extrusion passage 160 is located among bristles 126 of bristle set 125 with exterior orifice 165 located centrally on bristle surface 115. Toothpaste composition 195 contained within inner volume 145 is able to be extruded therefrom through extrusion passage 160 and through exterior orifice 165 into bristle set 125 via extruder 155.

Toothpaste extruding toothbrush 100 may be sold as kit (not shown) comprising the following parts: at least one toothbrush assembly 105 having snap on cover 175; at least one cleaning brush 190; at least one refill packets 180; and at least one set of user instructions. The kit has instructions such that functional relationships are detailed in relation to the structure of the invention (such that the invention can be used, maintained, or the like in a preferred manner). Toothpaste extruding toothbrush 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. The combination of a toothpaste extruding toothbrush, a plurality of refill packets, and a toothbrush assembly cleaning kit comprising:

a) a toothpaste extruding toothbrush comprising:
- a toothbrush assembly comprising;
  - a head portion including;
    - a bristle surface and a bottom section;
    - wherein said bristle surface and said bottom section are integrally formed with each other;
    - a bristle set;
    - wherein said bristle set is located on said bristle surface of said head portion;
  - a handle portion adapted to include;
    - a bottom portion and a top portion;
      - wherein said bottom portion and said top portion are snapped together to form an inner volume and an outer gripping portion, and wherein said bottom portion is integrally formed with said head portion;
  - an extruder;
    - wherein said extruder is located within said inner volume and is adapted to adjust a volume capacity of said inner volume;
  - an extrusion passage having a first end and a second end;
    - wherein said first end of said extrusion passage is connected to said inner volume of said handle portion and said second end of said extrusion passage is located on said bristle surface such that an exterior orifice is formed;

wherein a toothpaste composition contained within said inner volume is able to be extruded therefrom through said extrusion passage and through said exterior orifice into said bristle set via said extruder; and wherein said toothpaste extruding toothbrush is able to provide a convenient and easy to carry combination of said toothbrush containing said toothpaste composition for an oral hygiene when away from a home;

b) a plurality of refill packets comprising:

a refill container having;

a disposable container wherein said disposable container is formed of a flexible material joined forming an expandable inner volume; and c) a cleaning brush;

wherein said cleaning brush is suitable for cleaning said inner volume and said extrusion passage of said handle portion.

* * * * *